US005497900A

United States Patent [19]

Caleffi et al.

[11] Patent Number: 5,497,900

[45] Date of Patent: Mar. 12, 1996

[54] NECKED CONTAINER BODY

[75] Inventors: Antonio Caleffi, Nogara, Italy; T. William Ames, Park Ridge, Ill.; Edward S. Traczyk, Lockport, Ill.; Dietrich K. Naggert, Oak Forest, Ill.

[73] Assignee: American National Can Company, Chicago, Ill.

[21] Appl. No.: 430,745

[22] Filed: Apr. 28, 1995

Related U.S. Application Data

[63] Continuation of Ser. No. 957,629, Oct. 6, 1992, abandoned, and a continuation-in-part of Ser. No. 696,322, Jan. 30, 1985, and Ser. No. 725,945, Apr. 22, 1985, each is a division of Ser. No.453,232, Dec. 27, 1982, Pat. No. 4,519,232, said Ser. No. 957,629, is a continuation of Ser. No. 730,015, Jul. 12, 1991, abandoned, which is a continuation of Ser. No. 468,706, Jan. 23, 1990, abandoned, which is a continuation of Ser. No. 205,083, Jun. 10, 1988, abandoned, which is a division of Ser. No. 11,760, Feb. 6, 1987, Pat. No. 4,774,839.

[51] Int. Cl.[6] ..... B65D 7/42

[52] U.S. Cl. ..... 220/656; 220/906; 72/370

[58] Field of Search ..... 220/656, 906; 72/370

[56] References Cited

U.S. PATENT DOCUMENTS

| | | | |
|---|---|---|---|
| D. 289,736 | 5/1987 | Bowers, Jr. . | |
| 3,029,507 | 4/1962 | Gaggini . | |
| 3,763,807 | 10/1973 | Hilgenbrink | 72/370 |
| 3,786,957 | 1/1974 | Hilgenbrink | 220/83 |
| 3,812,696 | 5/1974 | Kneusel et al. | 72/57 |
| 3,964,412 | 6/1976 | Kitsuda | 72/364 |
| 3,964,413 | 6/1976 | Saunders | 72/370 X |
| 3,995,572 | 12/1976 | Saunders | 72/348 X |
| 4,058,998 | 11/1977 | Franek et al. | 72/84 |
| 4,173,883 | 11/1979 | Boik | 72/354 |
| 4,313,545 | 2/1982 | Maeda . | |
| 4,402,202 | 9/1983 | Gombas . | |
| 4,446,714 | 5/1984 | Cvacho . | |
| 4,450,700 | 5/1984 | Robertson, Jr. et al. . | |
| 4,512,172 | 4/1985 | Abbott et al. | 72/68 |
| 4,578,007 | 3/1986 | Diekoff | 72/370 X |
| 4,774,839 | 10/1988 | Caleffi et al. | 72/354 |

OTHER PUBLICATIONS

"This Success Story Will Take Your Breath Away" advertisement of Peerless Tube Company, Bloomfield, N.J. dated Jul. 1969.

"New Aluminum Bottle From Alcan" advertisement of Alcan Aluminiumwerke GmbH in Packaging Week dated approximately mid-1987.

*Primary Examiner*—Steven M. Pollard

*Attorney, Agent, or Firm*—Wallenstein & Wagner, Ltd.

[57] ABSTRACT

A die necking method and apparatus for producing a smooth tapered wall between the container side wall and a reduced diameter neck includes a plurality of rotatable necking turrets that each have a plurality of identical necking substations each having a necking die. The necking dies in the respective turrets have an internal configuration to produce a necked-in portion on the container which has a first arcuate segment integral with the container side wall and a second arcuate segment integral with the reduced diameter neck. The necking substations also have a floating form control element that engages the inner surface of the container to control the portion of the container to be necked. The necked-in portion is reformed in each succeeding turret by dies to produce a smooth tapered wall between the arcuate segments.

10 Claims, 8 Drawing Sheets

FIG. 3
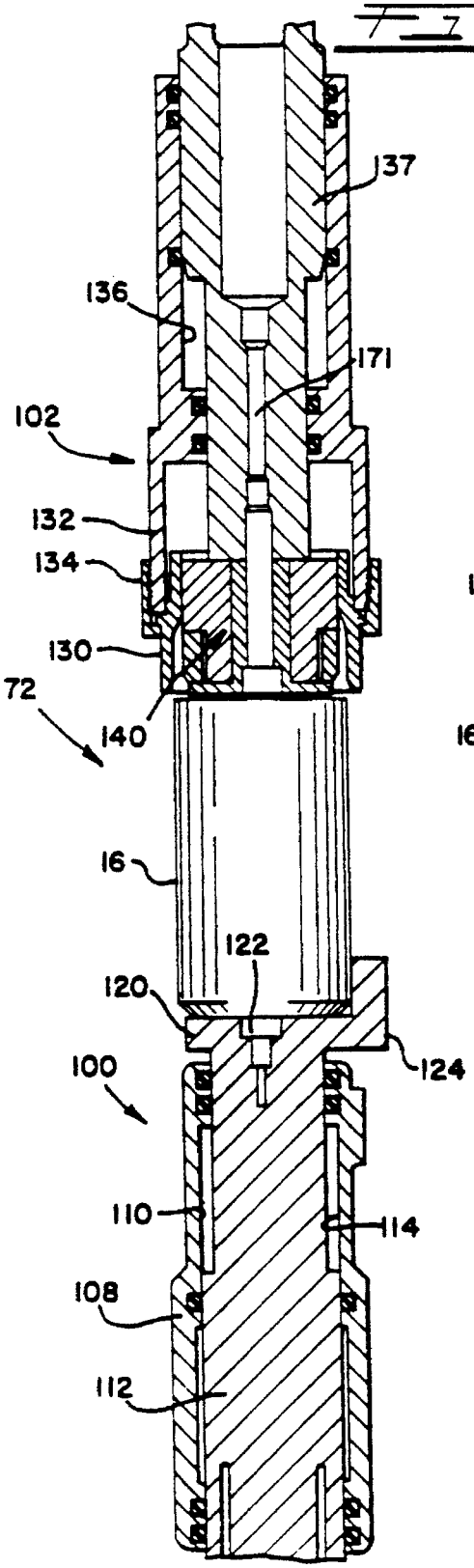
FIG. 4
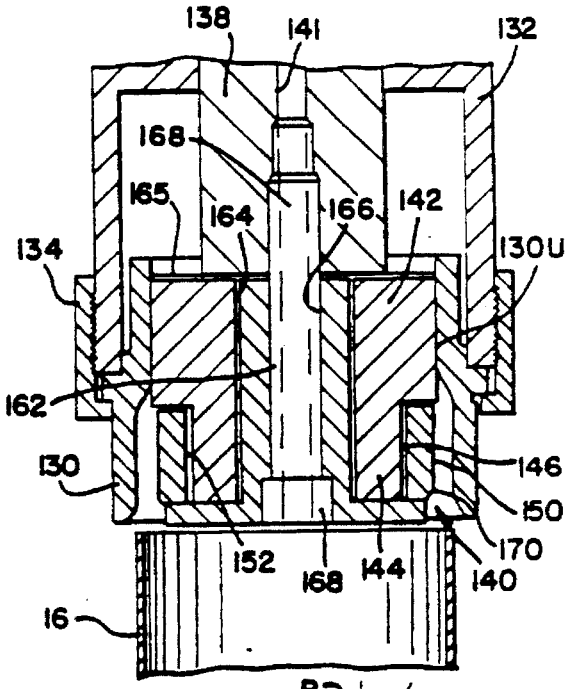
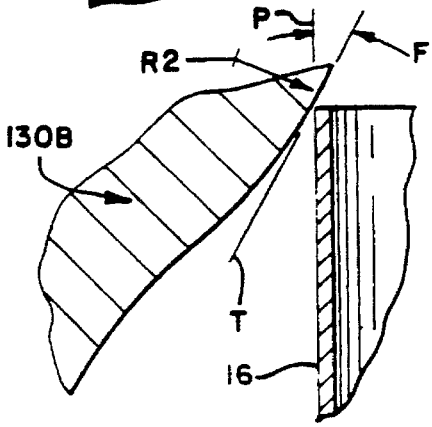
FIG. 5 t
L
N
W 137
137a
118c
118b
118a
118

290
288
286
R9
284
R8
280
R7
282

16

229
212
CR6
CR5
CR4
CR3
CT6
OR5
OR6
CA6
CR2
CR1
CA2
CA1
210

212
210

(a)
229
212
CR2
CA2
210
(b)
236
CR2
CA2
CA3
234
CT3
CR3
(c)
CR3
CT4
CA4
248
CR4
CT5
COR5
CA5
(d)
254
CR5
CR4
256
COR6
CA6
(e)
266
CR6
265
CT6

308
CSSR
304
302
300
307
306
CFSR

CSSR2
CT2
CSSR1
CT1
CFSR1
CFSR2

(a)
(b)
(c)
(d)
(e)
CSSR3
CT3
CFSR3
CSSR4
CT4
CFSR4
CSSR5
CT5
CFSR5
CSSR6
CT
CT6
CFSR6
10 TO 1

NECKED CONTAINER BODY

REFERENCE TO RELATED APPLICATIONS

This application is a continuation of 07/957,629, filed Oct. 6, 1992, now abandoned, which is a continuation of 07/730,015, filed Jul. 12, 1991 now abandoned, which is a continuation of 07/468,706, filed Jan. 23, 1990, now abandoned, which is a continuation of 07/205,083, filed Jun. 10, 1988 now abandoned, which is a divisional of 07/011,760, filed Feb. 6, 1987 now U.S. Pat. No. 4,774,839 issued Oct. 4, 1988. This application is also a Continuation-In-Part of U.S. Ser. No. 696,322, filed Jan. 30, 1985, refiled as Ser. No. 915,143, Oct. 3, 1986, and U.S. Ser. No. 725,945, filed Apr. 22, 1985, both of which are Divisional applications of U.S. Ser. No. 453,232, filed Dec. 27, 1982, now U.S. Pat. No. 4,519,232, entitled "Method and Apparatus for Necking Containers", issued to Edward S. Traczyk and Michael M. Shulski and assigned to National Can Corporation, the same Assignee as the present invention.

TECHNICAL FIELD

This invention relates generally to an improved two-piece container construction and the method and apparatus for necking and flanging such containers and, more particularly, concerns a versatile high-speed system for producing these containers.

BACKGROUND PRIOR ART

Two-piece cans are the most common type of metal containers used in the beer and beverage industry and also are used for aerosol and food packaging. They are usually formed of aluminum or tin-plated steel. The two-piece can consists of a first cylindrical can body portion having an integral bottom end wall and a second, separately-formed, top end panel portion which, after the can has been filled, is double-seamed thereon to close the open upper end of the container.

An important competitive objective is to reduce the total can weight as much as possible while maintaining its strength and performance in accordance with industry requirements. For pressurized contents such as soft drinks or beer, the end panel must be made of a metal thickness gauge that is on the order of at least twice the thickness of the side wall. Accordingly, to minimize the overall container weight the second end panel should be diametrically as small as possible and yet maintain the structural integrity of the container, the functionality of the end, and also the aesthetically-pleasing appearance of the can.

In most cases, containers used for beer and carbonated beverages have an outside diameter of 2 11/16 inches (referred to as a 211-container) and are reduced to open end diameters of (a) 2 9/16 inches (referred to as a 209-neck) typically in a single-necking operation for a 209 end; or, (b) 2-(7.5)/16 (referred to as a 207½-neck) typically in a double-necking operation for a 207½ end; or, (c) 2 6/16 (referred to as a 206-neck) in a triple- or quad-necking operation for a 206 end. In the future, it is expected that even smaller diameter ends will be used, e.g., 204, 202, 200 or smaller. Further, different can fillers use cans with varying neck size. Hence, it is very important for the can manufacturer to quickly adapt its necking machines and operations from one neck size to another.

Until recently, the process used to reduce the open end diameter of two-piece containers to accommodate smaller diameter second end panels typically comprised a die necking operation wherein the open end is sequentially formed by one, two, three or four die-sets to produce respectively a single-, double-, triple- or quad-necked construction. Examples of such proposals are disclosed in U.S. Pat. Nos. 3,687,098; 3,812,896; 3,983,729; 3,995,572; 4,070,888; and, 4,519,232. It will be noted in these instances that for each die necking operation, a very pronounced circumferential-step or rib is formed. This stepped rib arrangement was not considered commercially satisfactory by various beer and beverage marketers because of the limitations on label space and fill capacity.

In an effort to offset the loss of volume or fill capacity resulting from the stepped rib configuration of the container, efforts have been directed towards eliminating some of the steps or ribs in a container neck. Thus, U.S. Pat. No. 4,403,493 discloses a method of necking a container wherein a taper is formed in a first necking operation and this tapered portion is reshaped and enlarged while the angle of the taper is increased. A second step or rib neck is then formed between the end of the tapered portion and the reduced cylindrical neck.

U.S. Pat. No. 4,578,007 also discloses a method of necking a container in a multiple necking operation to produce a plurality of ribs. The necked-in portion is then reformed with an external forming roller to eliminate at least some of the ribs and produce a frustoconical portion having a substantially uniform inwardly curving wall section defining the necked-in portion.

In recent times beer and beverage marketers have preferred a neck construction having a relatively smooth neck shape between, for example, the 206 opening and the 211 diameter can. This smooth can neck construction is made by a spin necking process, and apparatus as shown, for example, in U.S. Pat. Nos. 4,058,998 and 4,512,172.

For various reasons, the can manufacturing industry believed that spin necking was the only method of producing a smooth neck configuration. Applicants have found, however, that presently available spin necking devices and their operation are not entirely satisfactory. It was found that commercial spin necking stretches and thins the neck metal and thereby tends to weaken the neck. From Applicants' experience, at commercial production speeds, the presently known spin forming apparatus and process requires frequent maintenance and attention and yet produces considerable scratches and ridges in the neck surface that are undesirable in the marketplace. Moreover, the spin-necked containers did not meet the performance standards set by the equivalent-sized die necked container. For example, Applicants experienced distortions in the symmetry of spin-necked containers, crush problems and uneven edges, which resulted in variations in flange width.

While presently-available spin necking equipment and operations have various shortcomings, no one to the knowledge of the Applicants has tried to make high-performance smooth necked cans by die necking, as taught herein. Apparently, the industry believed that the die necking process could not be effective in producing a totally smooth neck construction in a fast, economical, efficient and reliable manner.

SUMMARY OF THE INVENTION

According to the present invention, Applicants have developed a die necking process for making a high performance smooth neck construction in metal, two-piece, thin-walled containers. Applicants also have developed a versatile and readily changeable high-speed die necking apparatus and method that can produce at least 1,500 containers per minute.

The invention may be employed to die neck containers of various sizes. For purposes of explanation, the preferred embodiment of the invention is described with reference to necking the widely-used 211-diameter two-piece container down to a 206-diameter neck. A number of die necking sequences are performed to rapidly and efficiently produce a smooth tapered neck on the end of the cylindrical side wall of the container. In the embodiment shown, six necking operations are utilized to neck the "211" container to the "206" neck in sequential operations.

In operation, as the can passes through the apparatus after the initial operation, each of the die necking operations partially overlaps and reforms only a part of a previously-formed portion to produce a necked-in portion on the end of the cylindrical side wall until the necked-in portion extends the desired length. This process produces a smooth tapered annular wall portion between the cylindrical side wall and the reduced diameter cylindrical neck portion. The tapered annular wall portion which has arcuate portions on either end may be characterized as the necked-in portion or taper between the cylindrical side wall and the reduced diameter neck.

It has further been found that in practicing this method, the metal in the neck, which includes the necked-in portion and the reduced diameter neck portion, the metal is thickened and thus provides greater crush strength for the can independent of the profile and greater fill capacity.

The method of the present invention contemplates forming a cylindrical neck portion adjacent the cylindrical open end of a container so that the cylindrical neck merges with the cylindrical side wall through a generally smoothly tapered neck portion. The tapered neck portion between the cylindrical neck portion and the cylindrical container side wall initially is defined by a lower, generally arcuate segment having a relatively large internal curvature at the upper end of the cylindrical side wall and an upper, generally arcuate segment having a relatively large external curvature at the lower end of the reduced cylindrical neck.

A further tapered portion is then formed at the open end and is forced downwardly while the cylindrical neck is further reduced. The further tapered portion freely integrates with the second arcuate segment which is reformed and the tapered portion is extended. This process is repeated sequentially until the cylindrical neck is reduced to the desired diameter and a smoothly tapered necked-in portion is formed on the end of the side wall. In each necking operation, the tapered portion is not constrained by the die and is freely formed without regard to the specific dimensions of the die transition zone.

The container that is formed by the above die necking process has an aesthetically-pleasing appearance, greater strength and crush resistance and is devoid of the scratches or wrinkles in the neck produced in the spin necking operation.

Each container necking operation is preferably performed in a necking module consisting of a turret which is rotatable about a fixed vertical axis. Each turret has a plurality of identical exposed necking substations on the periphery thereof with each necking substation having a stationary necking die, a form control member reciprocable along an axis parallel to the fixed axis for the turret, and a platform being movable by cams and cam followers, as also explained in the above-cited U.S. Pat. Nos. 4,519,232, of which this application forms a continuation-in-part and which is incorporated herein by reference.

The form control member of the inventive system has a double or dual floating feature including a floating sleeve which engages the inner surface of the container adjacent the open end during the necking operation. Also, the entire form control member is mounted for floating radial movement on its support shaft. The dual floating form control element in the necking modules will produce a form control of the area of the container to be necked. Such form control assists in preventing any deformation along the open end from being moved into the necked portion of the container. It has been found that the floating form control member reduces spoilage significantly.

The necking modules are substantially identical in most respects and this allows maximum flexibility in installing and maintaining the system with minimum cost.

BRIEF DESCRIPTION OF SEVERAL VIEWS OF DRAWINGS

FIG. 1 of the drawings discloses in plan view a necking and flanging apparatus incorporating the modular nature of the present invention;

FIG. 3 is a cross-sectional view of one of the necking substations;

FIG. 4 is an enlarged fragmentary cross-sectional view of the form control member;

FIG. 5 is an enlarged fragmentary sectional view showing the relation between a container edge and a die-forming surface;

Figures 12, 13, 14, 15A, 15B:
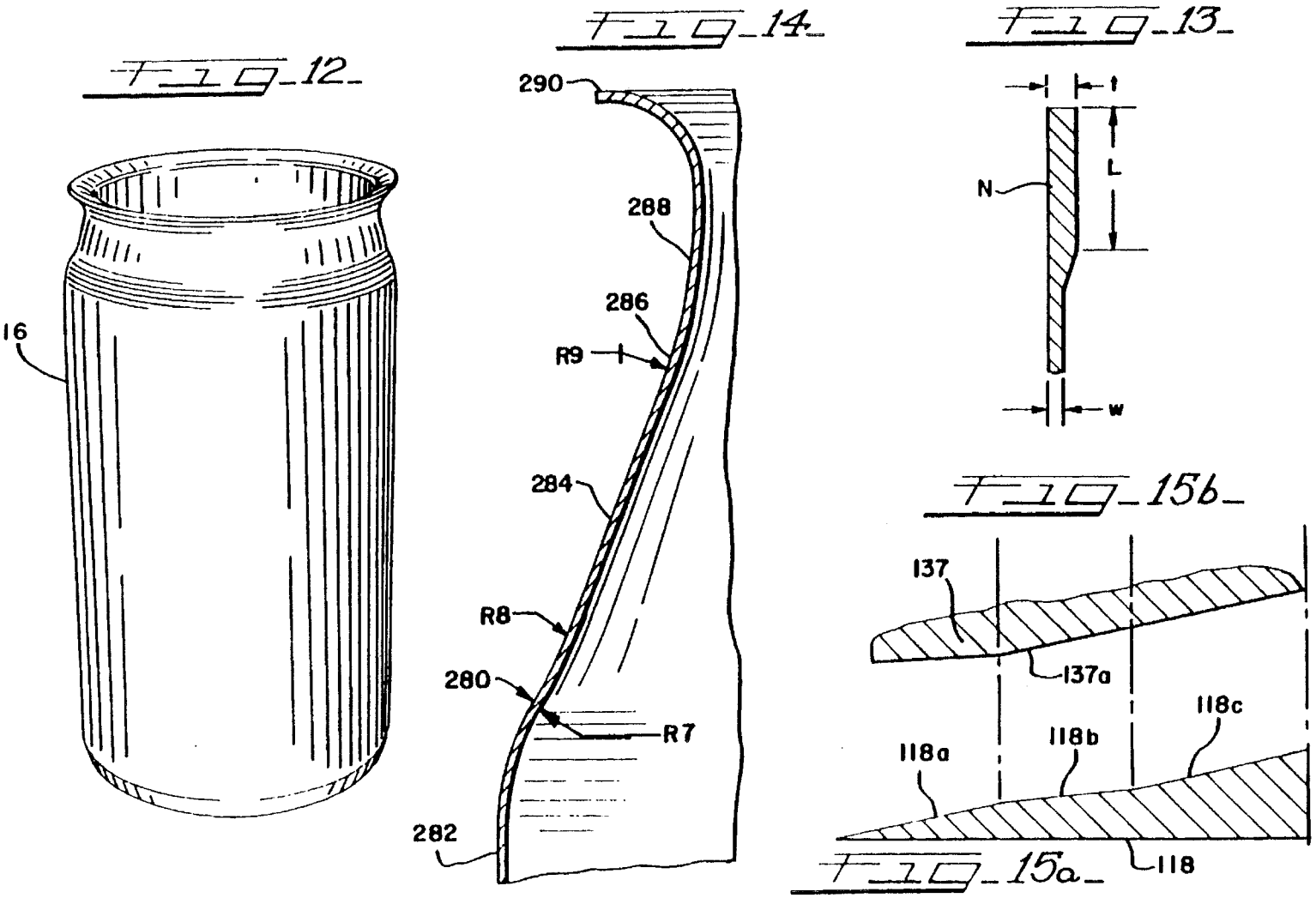
Figures 16, 17, 18:
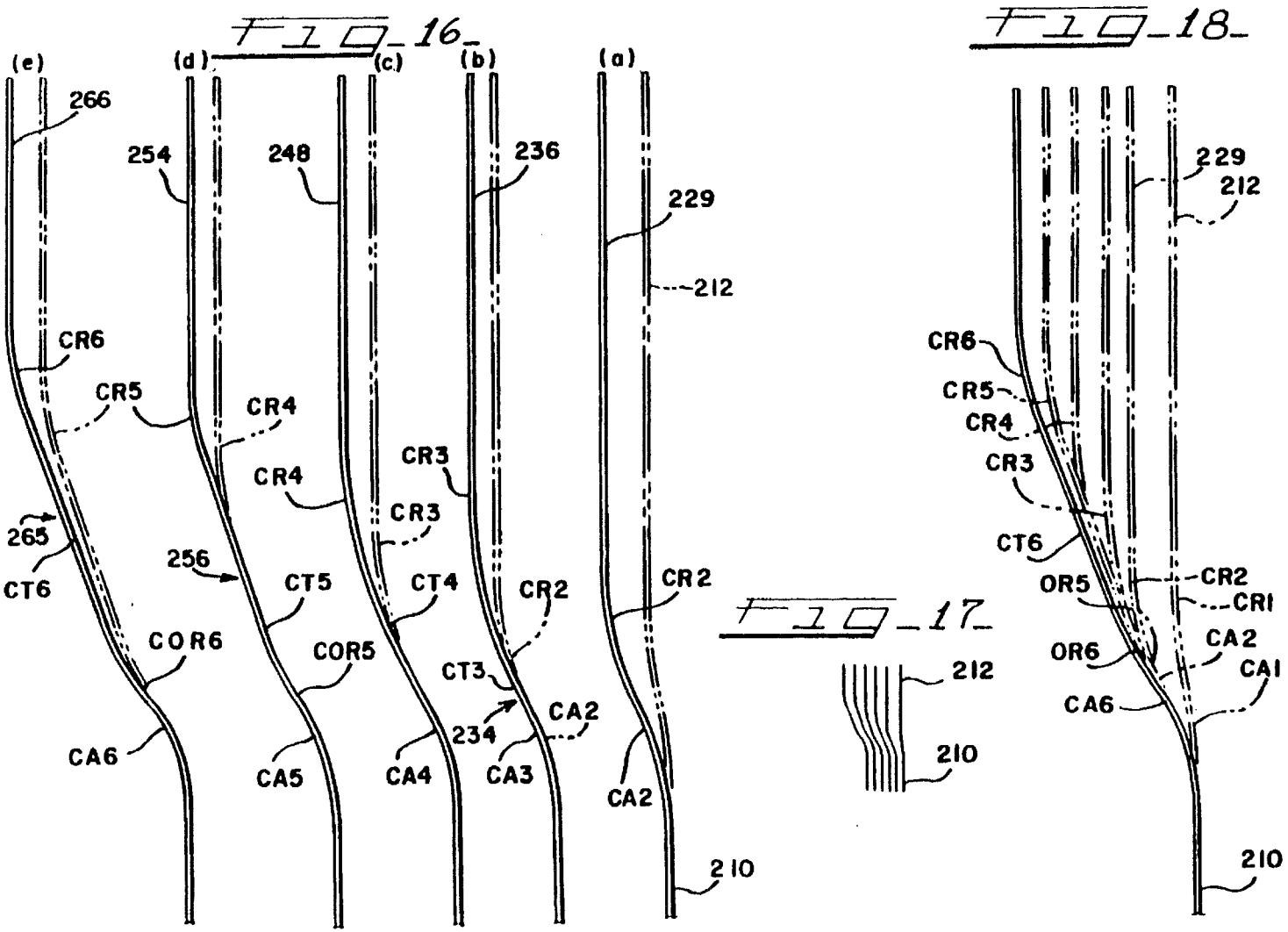
Figures 19, 20, 21:
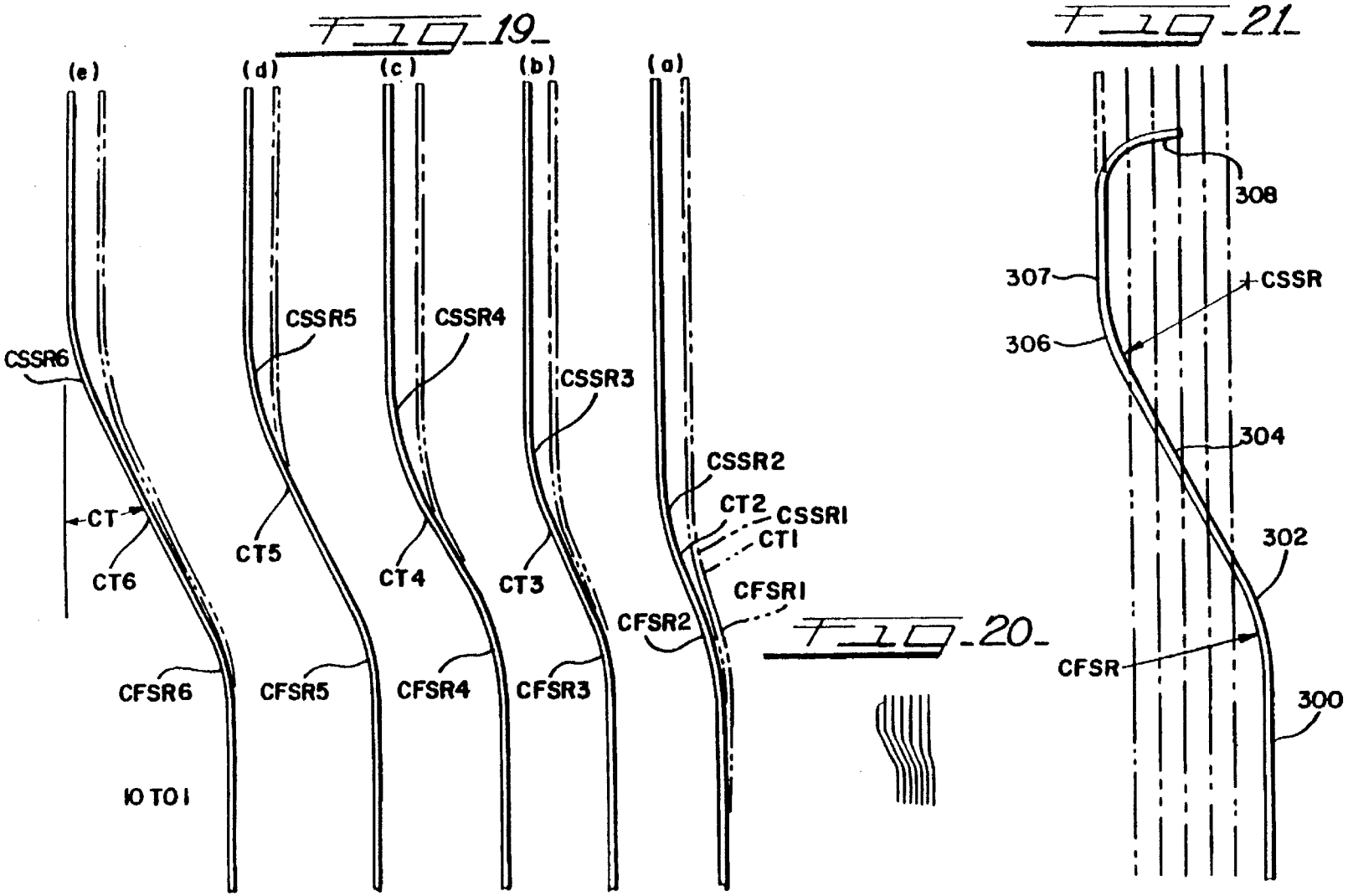

FIGS. 6–11 respectively show in sequence the six stages of tooling used in the necking operation;

FIG. 12 shows a finished necked and flanged container;

FIG. 13 is a fragmentary cross-sectional view of the upper end of the container before being necked;

FIG. 14 is a fragmentary enlarged cross-sectional view showing the finished necked and flanged container;

FIGS. 15(*a*) and (*b*) show the configuration of a portion of the cams that move the container and the form control member;

FIG. 16(a–e) show the progression of the container neck profile during the various necking operations;

FIG. 17 is substantially an actual size view showing the neck profile after each of the six necking operations;

FIG. 18 is an enlarged sectional view showing the neck of the container after each necking operation;

FIGS. 19(a–e) show the progression of a modified container neck profile during the various necking operations;

FIG. 20 is substantially an actual-size view showing the modified neck profile after each of the six necking operations; and, FIG. 21 is an enlarged cross sectional view of the finished modified neck profile.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

DETAILED DESCRIPTION

Figure 1:
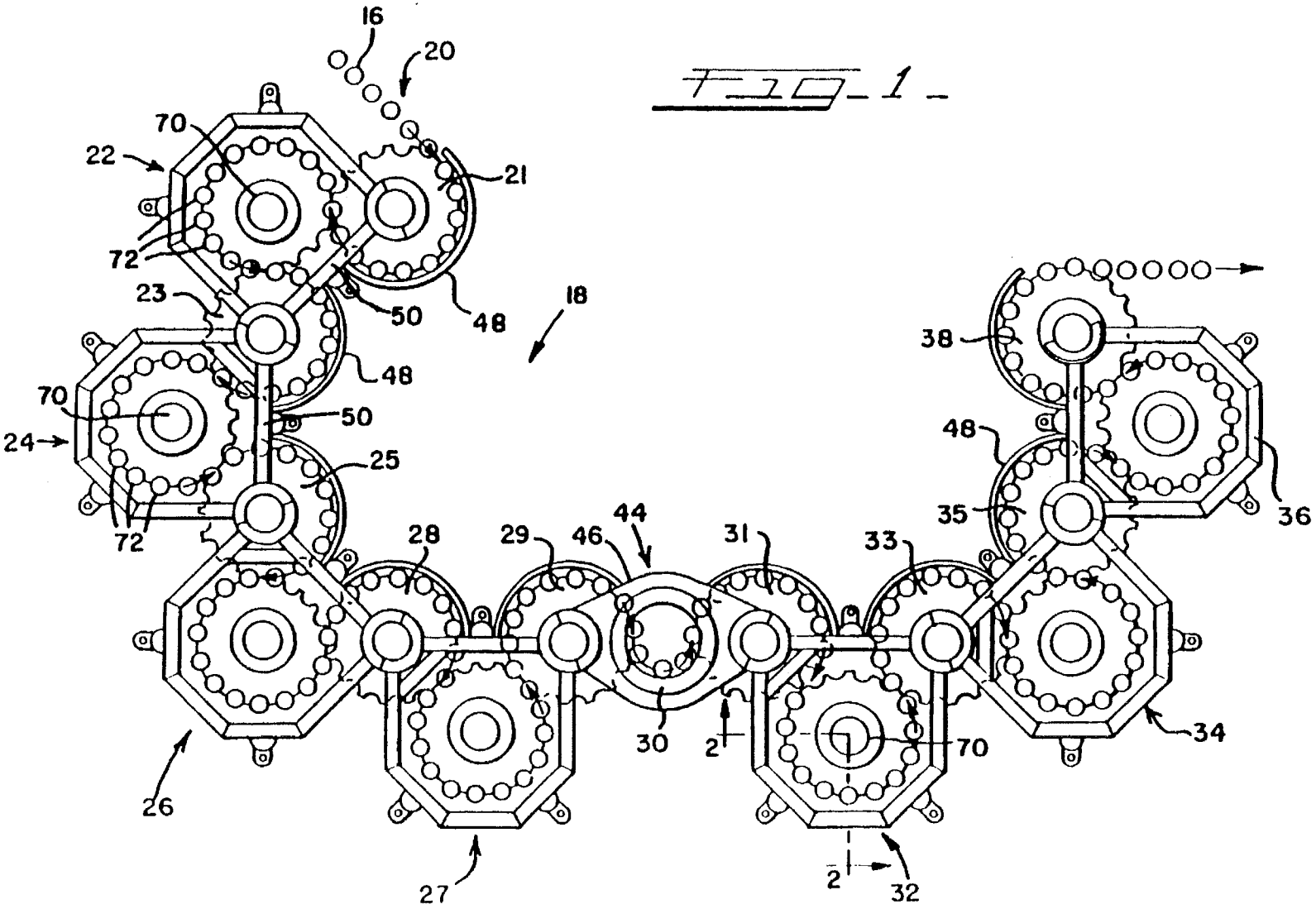

FIG. 1 of the drawings discloses in plan view a necking and flanging system or apparatus, generally designated as 18, for producing containers according to the invention herein which containers have a smooth-shaped neck profile and an outwardly-directed flange.

As will be described more specifically below, the necking and flanging apparatus 18 includes a plurality of substantially identical modules comprising the necking stations that are positioned in a generally C-shaped pattern, as shown in FIG. 1. A single operator can visually observe and control the operation of all modules from a central location. The plurality of individual modules are interconnected to provide the complete necking and flanging system or apparatus, as will be explained.

FIG. 1 depicts metal container bodies 16 being fed along a path 20 for-necking to apparatus 18. As mentioned above, the embodiment of FIG. 1 has six container necking station modules, identified by numerals 22, 24, 26, 27, 32, 34, respectively, and a flanging station module 36. Nine transfer wheels 21, 23, 25, 28, 29, 31, 33, 35 and 38 move the containers serially and in a serpentine path through the various necking stations.

Each of the necking station modules 22, 24, 26, 27, 32 and 34 are substantially identical in construction so as to be interchangeable, and can be added to or subtracted from the system depending upon the type of container that is to be formed. Each of the necking station modules has a plurality of circumferentially-spaced individual, substantially identical necking substations (FIG. 3). The number of stations and substations can be increased or decreased to provide the desired necking operation for various sizes of cans. The details of the necking substations will be described in further detail later.

An additional advantage of utilizing substantially identical modules is that many of the components of the modules are identical in construction, thus enabling a reduction of inventory of parts.

The arrangement of FIG. 1 shows cylindrical metal container bodies 16 which are made of conventional materials in any conventional manner, being fed sequentially by suitable conveyor means (not shown) into the necking and flanging apparatus 18. The conveyor means feeds the containers to a first transfer wheel 21, as is known in the art. The containers are then fed serially through the necking modules by the interconnecting transfer wheels.

More specifically, the first transfer wheel 21 delivers containers 16 to the first necking module, generally designated by reference numeral 22, where a first necking operation is performed on the container, as will be described later. The containers 16 are then delivered to a second transfer wheel 23 which feeds the containers to a second necking module 24 where a second necking operation is performed on the container. The container is then removed from the second module by a third transfer wheel 25 and fed to a third necking module 26 where a third necking operation is performed.

As will be explained in more detail hereinbelow, each station is concurrently operating on, or forming, a number of containers with each container being in a different state of necking as it is being processed from the entry point to the exit point of each necking station module.

The containers are then sequentially moved through the fourth, fifth and sixth necking modules 27, 32 and 34 to complete the necking operation. The necked containers 16 are next moved by transfer wheel 35 to a flanging module 36 where an outwardly-directed flange is produced on the container, as is well known in the art, and is delivered to a transfer wheel 38 for delivery to an exit conveyor (not shown).

All of the moving members in the necking and flanging apparatus are driven by a single drive means 44 which includes a variable-speed motor connected to an output transmission 46. Each of the transfer wheels, as well as the necking modules and flanging module, have gears in mesh with each other to produce a synchronized continuous drive means for all of the components.

The variable-speed drive feature of drive means 44 allows automatic increase and decrease of speed of the module to match the quantity of containers flowing through the module to the flow in the remainder of the container line. The variable-speed drive also allows the operator to accurately index the components of the system relative to each other.

The necking and flanging apparatus also has suitable container guide elements 48 associated with each of the modules and on each of the transfer wheels to assure that the containers remain in the conveyor track.

Figure 2:
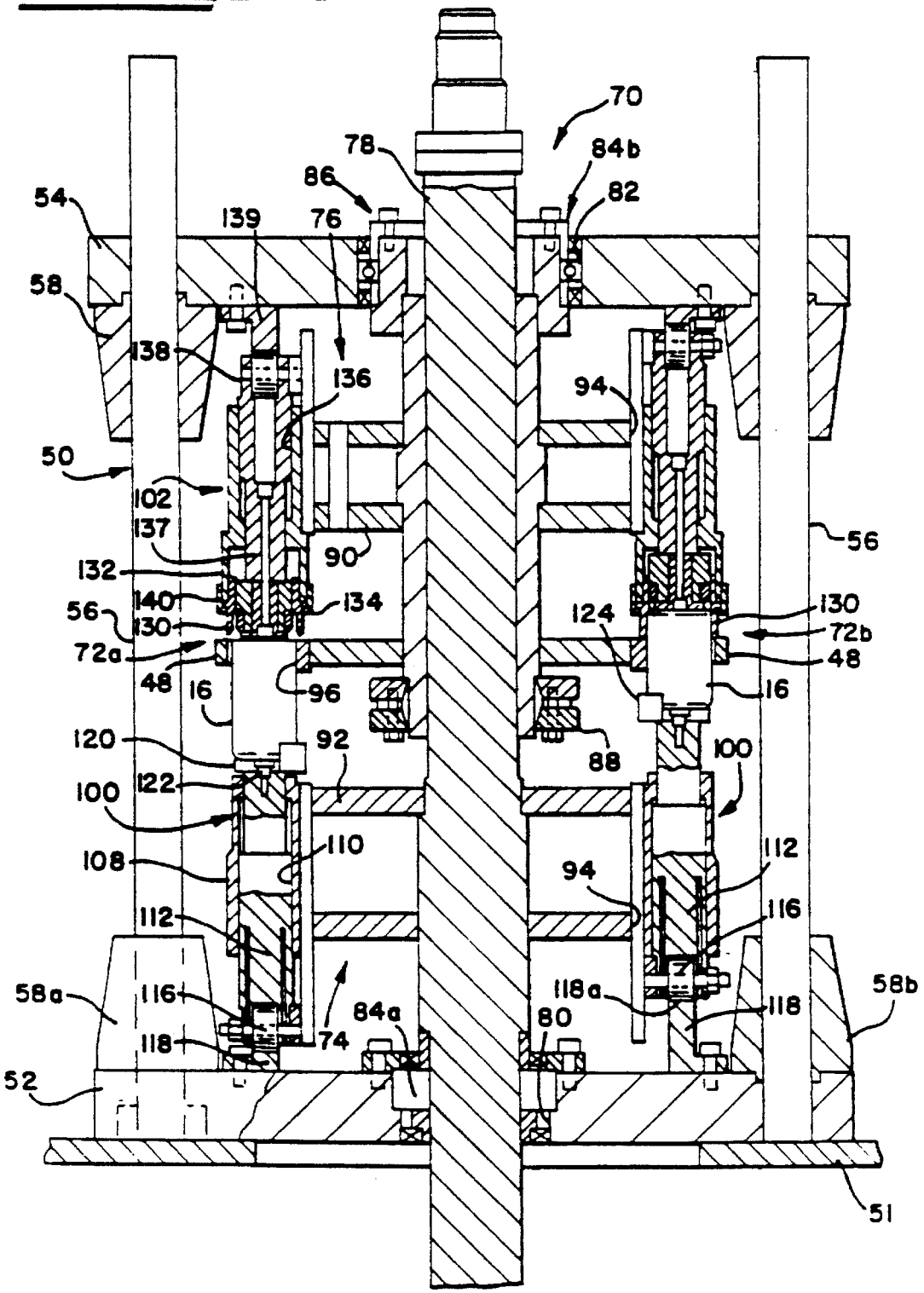
FIG. 2 is a cross-sectional view of one module showing two necking substations, as viewed along line 2—2 in FIG. 1.

A suitable interconnecting and supporting framework, generally designated by reference numeral 50, is provided for supporting rotatable turrets 70 that are part of the modules. Referring now to FIG. 2, the fixed or stationary framework 50 is supported on a platform or base 51 and includes a lower frame member 52 and an upper frame member 54 interconnected by columns 56. Collars 58 suitably connect columns 56 to frame members 52, 54 by bolts (not shown) so that a solid structure is provided to assure the accuracy of alignment of the various movable components, which will be described later.

The frame structure 50 provides a fixed support above the base 51 for a rotary turret assembly 70 that holds a plurality of identical necking substations, generally designated as 72 in FIG. 1, around the periphery thereof and in fixed relation to each other. FIG. 2, which is a view partially in cross-section, taken along line 2—2 of FIG. 1, shows two of the substations 72*a* and 72*b*. The turret assembly 70 as shown in FIG. 2 comprises a lower turret portion 74 and an upper turret portion 76 supported on a central drive shaft 78 that extends through openings 80 and 82 in frame members 52 and 54. Turret assembly 70 is rotatably supported on the frame members by suitable bearing means 84*a* and 84*b*. Note that substations 72*a* and 72*b*, as well as all the other substations 72, rotate with shaft 78 while columns 56 remain substantially stationary. The upper turret portion 76 is of hollow cylindrical shape and is slidably positionable on shaft 78, being secured in an adjusted position by a wedge mechanism 86 and a collar 88. The lower turret portion 74 is fixed to the lower part of shaft 78. The slidably-positionable feature of the upper turret portion 76 allows the turret portion 76 to be accurately repositioned longitudinally on shaft 78 relative to turret portion 76 without changing the alignment of the necking substations; this permits the turret assemblies 70 to accommodate containers of different heights.

A radially-extending upper hub means 90 forms part of the upper turret portion 76 and provides support means for the upper portion of the necking substations 72, to be described. Likewise, lower hub means 92 extend radially outwardly to form part of the lower turret portion 74 and to support the lower portion of the necking substations 72, to be described. The hub means 90, 92 have aligned pockets 94 on the outer periphery thereof which are machined as matching pairs to receive the components of the substations 72 and insure accurate alignment of the upper and lower portions of the necking substations 72. Also, the upper hub means 90 also has pockets 96 which cooperate with guide elements 48 to control the position of the containers as they are moved through the necking station module.

As stated above and as shown in FIG. 2, the substations are substantially identical, and a description of one substation 72 exemplifies the structure of the other substations in each of the station modules.

FIG. 3 discloses in greater detail necking substation 72 comprising a lower container-lifting portion, generally indicated at 100, and an upper forming or necking portion, generally indicated at 102. Referring now to both FIGS. 2 and 3, the container-lifting portion 100 includes an outer cylindrical member or sleeve 108 that has a generally circular opening 110 with a ram or piston 112 reciprocably movable in the opening 110. The lower end of ram 112 has a cam follower 116 (see FIG. 2) which rides on an upper exposed camming surface of a face cam 118 supported on lower frame member 52. The upper end of ram 112 has a container supporting platform 120 secured thereto by fastener means 122. The support platform or container support means has an inner upwardly-arcuate extension 124 for engaging the inner lower surface of the container. Ram 112 cooperates with sleeve 108 to provide both a fluid centering mechanism and to bias the cam followers 116 into engagement with the cam 118, as described in more detail in U.S. Pat. No. 4,519,232, incorporated herein by reference.

The cam 118 essentially comprises a fixedly-mounted ring circumferentially seated on lower frame member 52. The cam is of selected height and configuration and aligned with the lower end of the substations 72 to control the upward and downward movement of the piston 112 and hence of the container 16 as the turret is rotated on the fixed frame 50. Since the cam followers 116 are biased into engagement with the cam 118, the configuration of the camming surface of the face cam will dictate the position of the container 16, as will be described later.

The upper necking portion 102 includes a fixed necking die element 130 that is secured to a hollow cylinder 132 by means of a threaded cap 134. The cylinder 132 has an axial opening 136 in which a hollow plunger or shaft 137 is reciprocally mounted. A cam follower 138 (see FIG. 2) is mounted on the upper end of shaft 137 and rollably abuts on an exposed camming surface of a fixed upper face cam 139 secured to upper frame member 54.

Plunger 137 and cam follower 138 are maintained in engagement with the cam 139 by fluid pressure which also centers the shaft 137 in the opening 136, all as explained in U.S. Pat. No. 4,519,232. The lower end of plunger 137 supports a form control member 140, to be explained. Also, the plunger 137 and the form control member 140 have an opening 141 for introducing pressurized air into the container during the necking operation, as will be explained later.

In operation of the module, shaft 78 is caused to rotate about a fixed axis on the stationary frame 50. Containers 16 are moved onto the platform 120 and into engagement with arcuate extension 124 when the lower lifting portion is in the lower-most position, shown in substation **72*a* at the left-hand side of FIG. 2. The configuration of the lower cam 118 is such that the container is moved up into the die 130 as the shaft 78 is rotated and therefore the upper open end of the container is incremently reformed. At about the time the upper edge of the container contacts the die 130, pressurized air is introduced into the container from a source (not shown) through opening 141. As the turret assembly 70 is rotated about 120° of turret rotation, the upper cam 139 is configured to allow the form control member 140 to move upwardly based on the configuration of the cam. As mentioned above, shaft 137 including the form control member 140 is biased upwardly by fluid pressure, and will move upwardly to the position shown at substation 72*b* as the turret assembly rotates. Thereafter, during the remainder of the 360° rotation, the cams 118 and 139 are configured to return the platform 120 and form control member 140 to their lower-most positions at substantially matched speeds while the necked container is removed from the die. During this downward movement, the pressurized air in the container will force the container from the die onto the platform 120. Containers 16 are continually being introduced onto platform 120, processed and removed as indicated in FIG. 1**.

The relative vertical movement of the container 16 and the form control member 140 is important to minimize frictional forces developed between the container and the necking die during the necking operation. Thus, the vertical or upward velocity of the form control member is greater than the vertical or upward velocity of the container during the portion of the cycle of revolution where the necking takes place and preferably is about 5% greater. This relative movement is controlled by the configuration of the cams 118 and 139 and is illustrated in FIG. 15.

The cams are preferably segmented into three equal segments of about 120°, and one segment is shown in FIG. 15. The camming surface segment **118*a* of cam 118, FIG. 15**(*a*), moves the container 16 upward until the upper edge of the container contacts the die 130. The upward velocity of the container is then reduced by the flattened camming surface segment **118*b* between the time the container 16 edge contacts the die 130 and the time the container edge contacts the form control member 140. This allows the container to be centered in the die and the form control member 140 to be centered in the container. The upward velocity of the container is then increased by the camming surface segment 118*c* during the remainder of the necking cycle. At the same time, the cam surface 137*a* of the upper cam 137 is configured to begin upward movement of the form control member at a constant velocity as the container edge engages the die 130**.

The container and form control member are then lowered at about the same velocity while the pressurized air forces the container out of the die.

Refer now to FIG. 4, as well as FIGS. 2 and 3, according to one aspect of the invention, the form control member 140 has an internal forming sleeve or element 150 which is supported for radial floating movement to accommodate relative movement of the forming element with respect to a fixed necking die 130.

More specifically, the form control member 140 consists of a hollow cylindrical member 142 that has a stepped lower end portion 144 of reduced external diameter 146. A forming sleeve 150 is mounted on the end portion 144. Sleeve 150 has a diameter 152 which is slightly larger than the external diameter 146 of end portion 144 and is held on member 142 by a cap that has an integral elongated section or rod 162 which extends through the axial opening 164 in the member 142. The rod 162 has an opening 166 therethrough which receives a hollow bolt 168 to fixedly secure the cap to the plunger 137, and the hollow bolt 168 defines part of an axial opening 141. The lower edge of sleeve 150 has a tapered outer edge 170 which will act to center the forming sleeve 150 with respect to the container 16 as it is entering the open end.

Thus, the diameter of the axial opening 164 is slightly larger than the external diameter of rod 162 and the axial length of the member 142 is slightly less than the length of the rod. The foregoing provides a slight vertical spacing 165 between the upper end of member 142 and the lower edge of shaft 137 to allow for radial play or movement of the body 142 on the rod 162.

Thus, the forming sleeve 150 is mounted for floating radial movement on the cylindrical member 142 while the cylindrical member 142 is mounted for floating radial movement on the plunger or shaft 137 to provide a double floating feature or movement for forming element or sleeve 150.

It will be appreciated that, in the embodiment shown, the clearances have been exagerated in FIG. 4 and that the clearance between the member 142 and the forming element 150 is about 0.003±0.001 inch. Also, it is desirable to have no clearance between the external surface of the member 142 and the internal surface of the upper portion 130U of the die 130. The clearance between the member 142 and the support rod 162 is about 0.005 inch.

As mentioned above, the "double float" of the forming sleeve or element 150 will accommodate alignment of the main body 142 of the form control member 140 with the fixed necking die 130 while the floating or radially-movable forming element 150 will move with respect to the fixed necking die 130 and the cylindrical member 142 to be centered in the container. The internal opening in the upper portion 130U of the necking die 130 and the external diameter of the forming sleeve or element 150 are dimensioned such that there is minimal clearance, referably less than 0.0002 inch between the two when the edge of the container 16 is received therein. Thus, the metal of the the container 16 becomes trapped or confined between the forming sleeve or element 150 and the upper portion 130U of die 130 and the double floating forming element will result in "form control" to maintain the concentricity of the container for all of the area that is to be necked. This is particularly true in the first necking operation where the upper portion of the container is conformed to the desired concentricity, and wherein wall variations are minimized, and any container defects, particularly nicks or dents adjacent the edge, are minimized or eliminated.

The present invention provides a method whereby a container can be necked to have a smaller opening by utilizing a plurality of necking modules. In the illustrated embodiment of FIG. 1, six different necking operations and one flanging operation are performed on the neck of the container. An upper part of the necked-in or inwardly-tapered portion is reshaped during each of the necking operations. In each necking operation, a small overlap is created between a previously necked-in portion while the overall necked-in portion is extended and axially enlarged and small segments of reduction are taken so that the various operations blend smoothly into the finished necked-in portion. The resultant necked-in portion has a rounded shoulder on the end of the cylindrical side wall which merges with an inwardly-tapered annular straight segment through an arcuate portion. The opposite end of the annular straight segment merges with the reduced cylindrical neck through a second arcuate segment.

The necking operation will be described by reference to FIGS. 6–11. In the embodiment described, a "211" aluminum container is necked to have a "206" neck in six operations. Assume that a container 16 carried by a conveyor, as indicated in FIG. 1, has been moved into position, such as shown in substation 72*a* in FIG. 2, and the necking operation is being initiated. FIGS. 6–11 depict the necking operation performed in the six necking station modules.

Referring briefly to FIG. 13, the container 16 typically has a thickened portion adjacent its upper open end before the necking operations are performed. In the embodiment shown, container 16 has a side wall that has a thickness (W) which is on the order of about 0.0040–0.0050 inch thick, while an upper neck area (N) has a thickness (t) that is on the order of about 0.0075 inch down to about 0.0050 inch while the length (L) is on the order of about 0.37 to 0.90 inch.

Figure 6:
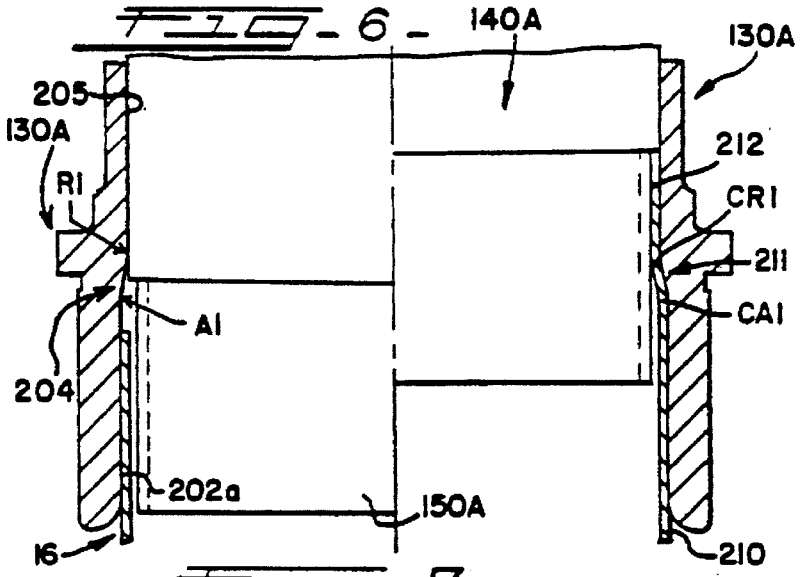

The left side portion of FIG. 6 shows a container 16 being moved upwardly into a necking die 130A. As the open end of the container 16 is moved into engagement with the die, the forming angle in the die results in large radial forces on the container wall and small axial forces so that there is radial compression of the wall of the container, as will become clear.

FIG. 6 shows a necking die 130A having a first cylindrical wall portion 202*a*, a transition zone surface 204, and a second cylindrical wall portion 205. The first cylindrical wall portion 202*a* has a diameter approximately equal to the external diameter of the container 16 with a clearance of about 0.006 inch. The second cylindrical wall portion 205 has a reduced diameter equal to the external diameter of the reduced neck that is being formed in the first necking operation.

The transition zone or intermediate surface 204 has a first arcuate surface segment A1 at the end of the first cylindrical wall portion 202 which has a radius of about 0.220 inch and a second arcuate surface segment R1 at the end of the second cylindrical wall portion 205 which has a radius of about 0.120 inch.

As the container 16 is moved upwardly into the die element 130A, as depicted on the right-hand side of FIG. 6, the diameter of the container neck is reduced and a slight curvature 211 is formed on the container body between the reduced cylindrical neck 212 and the container side wall 210.

In the first operation, the diameter of the neck is reduced only a very small amount, e.g., about 0.030 inch, while the portion of the container to be necked is conditioned for subsequent operations. In other words, a form control operation is performed on the ultimate neck portion to prepare the container for subsequent operations.

This is accomplished by tightly controlling the dimensions and tolerances of reduced cylindrical surface 205 of die 130A and the external surface diameter of the forming sleeve or element 150A. The external diameter of sleeve or element 150A is equal to the internal diameter of cylindrical surface 205 less two times the thickness of the container side wall (t) with a maximum of 10% clearance of the wall thickness. By thus tightly controlling these dimensions, dents or imperfections in the container are removed or minimized, and also any variations in wall thickness around the perimeter of the neck are reduced to provide concentricity of the side wall of the container with the die.

Also, as mentioned above, during the movement of container 16 from the position illustrated at the left of FIG. 6 to the position at the right of FIG. 6, pressurized air may be introduced into the container through opening 141 (FIG. 4)

to pressurize it, if considered necessary, and thereby temporarily strengthen the container. This air is used primarily to strip the container from the necking die 130A after the necking operation is completed. As explained above during the upward movement of the container 16, the forming control member 140A and forming sleeve or element 150A are moved upwardly slightly faster than the container 16 to aid in drawing or pulling the metal of the container wall into the die.

At the first forming station, the die element 130A forms the container 16 to have a tapered-in or necked portion 211 between a cylindrical side wall 210 and a reduced cylindrical neck 212; the tapered portion 211 includes first and second arcuate segments CA1, CR1, respectively.

After the first necking operation is completed, the partially-necked container 16 exits therefrom and is fed to the second forming station module. In the second necking operation, the necked-in portion is axially elongated while the reduced cylindrical neck portion 212 is further reduced in diameter by compression of the metal therein. This is accomplished by a second necking die 130B (FIG. 7) that has a transition zone 222 between a cylindrical first surface 202*b*, which has the same internal diameter as the external diameter of the container, and a reduced cylindrical surface 226 at the upper end thereof. The transition zone 222 again has a first arcuate surface segment A2 integral with the cylindrical wall surface 202*b* and a second arcuate surface segment R2 integral with the reduced diameter cylindrical surface 226.

Figure 7:
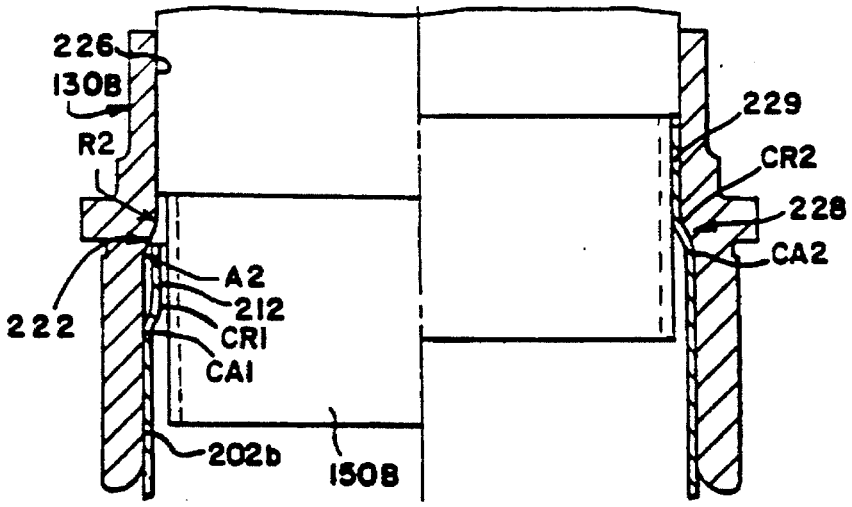

Referring to FIG. 7, the surface 222 of die element 130B of the second necking station initially engages the upper edge of the container 16 with arcuate die surface R2 at a small acute forming angle.

It has been found that the curvature or radius at the point which the container 16 is contacted by the die 130B and the forming angle produced between the contact point and a plane parallel to the axis of the container are critical to produce a necked-in container that is free of wrinkles. This angle, which is also referred to as the forming or locking angle, must be kept small so that radial forces known as radial hoop stresses rather than axial forces are developed to neck the container.

In FIG. 5, the tangent line T to the die wall surface defines the point of contact with the upper edge of the container 16 and results in a small impingement or forming angle "F" with a plane "P" extending parallel to the side wall of the container. It has been found that if this angle "F" is maintained in the range of about 15° to 20°, most of the forces will be radial forces to compress the neck of the container rather than axial forces. Axial forces will tend to provide more of a bending action as in conventional die necking operations.

It has also been determined that having a die contact the container 16 at the small forming angle "F" allows the container 16 necked-in portion to essentially "free form" or taper toward the point where the upper end of the container 16 engages the outer surface of the forming sleeve or element 150B. This allows the container to freely define or assume its own profile rather than having a die inner wall surface dictate the shape of the profile, as has been accepted technology in prior necking operations. This is in contrast to prior die necking processes, such as disclosed in U.S. Pat. No. 3,995,572 wherein the metal is forced to assumed the shape of the inner surface of the necking die.

The radius of curvature of the arcuate surface segment A2 in the second necking die is on the order of about 0.280 inch, while the radius of curvature of the second arcuate surface segment R2 is about 0.180 inch. Thus, as the container is moved from the left-hand position, shown in FIG. 7, to the right-hand position, the original tapered portion is axially elongated to produce a tapered portion 228 having arcuate segments CA2, CR2 while the reduced diameter cylindrical portion 212 is reduced to a further reduced diameter, as shown at 229.

In the second necking operation, the diameter of the reduced cylindrical neck is reduced by about 0.070 inch, while the metal is further radially compressed therein. In the second necking die 130B, the forming angle described above is defined by the arcuate surface segment R2. FIG. 16(*a*) shows the configuration of the neck in dotted line before the second necking operation, and in solid line after the second necking operation. It will be noted that the lower segment of the tapered portion adjacent the cylindrical side wall remains substantially unchanged while the second arcuate segment or upper part of the tapered portion is reformed and the tapered portion is axially elongated.

During the second operation, a second tapered portion is essentially freely formed in the reduced cylindrical neck being free of the die at its lower end and this second tapered portion is forced along the reduced neck portion until it integrates with the arcuate segment CR1 of the first tapered portion. During this second operation, the lower part of the first tapered portion remains essentially unchanged while the second tapered portion combines and blends with the first tapered portion to produce an extension thereof.

It will be appreciated that the necking operation performed at each of the various stations is somewhat repetitive; however, for completeness of description, each of the necking operations at the various stations and the pertinent angles and curvatures will be described hereinbelow. It should be appreciated that, in fact, each station performs a part, and not all, of the necked-in portion while the cylindrical neck is sequentially and progressively reduced in diameter. That is, each station adds to and at least partially reforms and extends the necked-in portion produced on the container by the previous operation.

Figure 8:
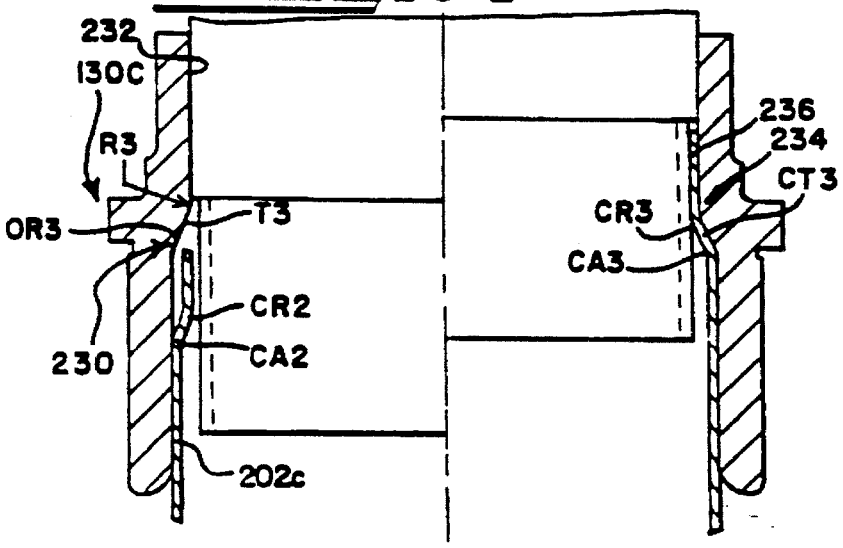
Figure 9:
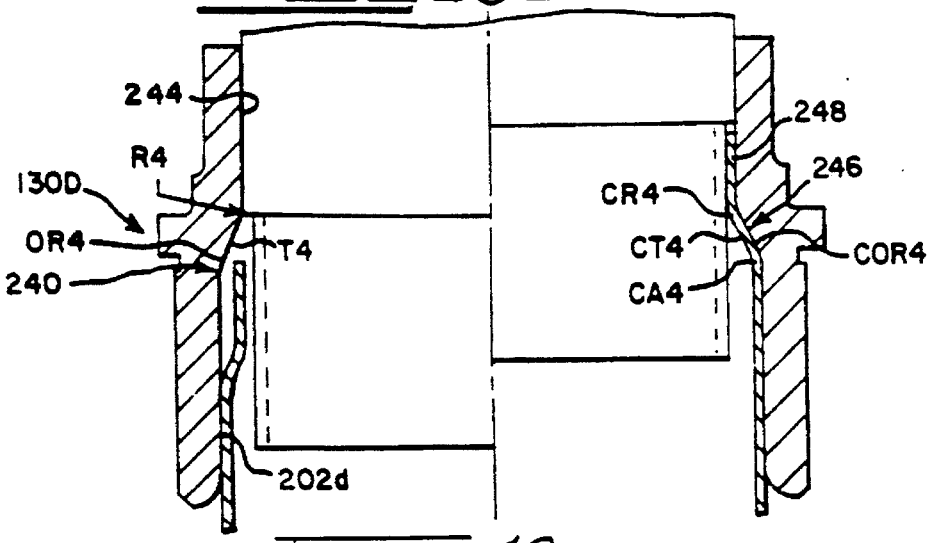
Figure 10:
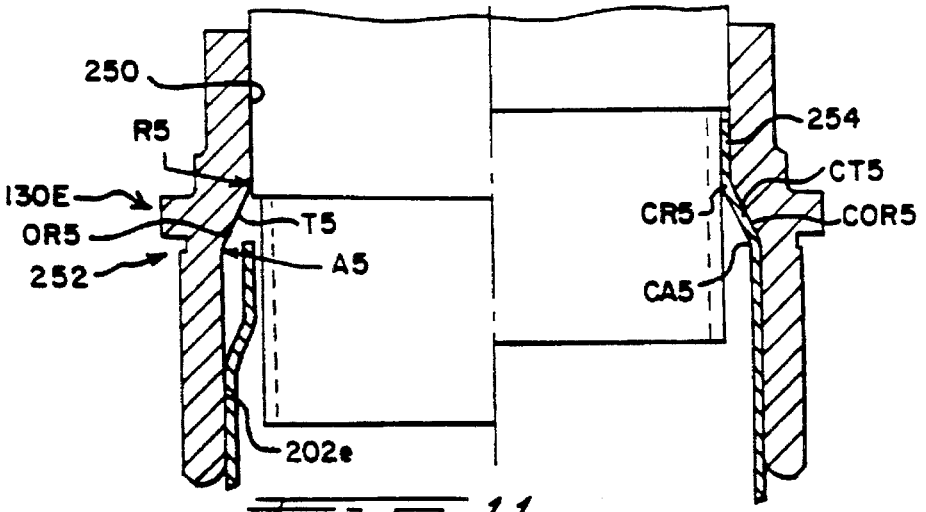

The third, fourth and fifth necking operations are illustrated in FIG. 8, 9 and 10 and are essentially identical to the second necking operation. The dies and the form control members of the third, fourth and fifth stations are substantially identical in construction except for the slight change in die dimensions.

At each subsequent station, the cylindrical neck is compressed and reduced while the existing tapered or necked-in portion is partially reformed and axially elongated or extended to produce a small annular inwardly-tapered portion between the upper and lower arcuate segments described above.

In the third necking die 130C (FIG. 8), the transition surface 230 is located above cylindrical member 202*c* and includes an upper arcuate surface segment R3 having a radius of about 0.260 inch, with a straight tapered wall surface T3 which defines an inclined angle of about 27°. The lower arcuate surface segment includes a relief area on the end of the cylindrical wall surface and a second arcuate surface segment OR3 having an external radius of about 0.180 inch. The reforming operation between the second and third operations is illustrated in FIG. 16(*b*) where the necked-in portion 234 of the container has a first arcuate segment CA3, a tapered segment CT3, a second arcuate portion CR3 and a reduced neck 236. It will be noted that the arcuate segment CA2 remains essentially unchanged because there is no contact with the die while the arcuate segment CR2 is reformed and the center thereof is moved axially upwardly so that the tapered portion is extended. Also, the tapered portion CT3 does not conform to the flat tapered wall surface T3 and instead has a compound curve after the third necking operation.

In the fourth necking die 130D (FIG. 9), the transition zone 240 above the cylindrical surface 202*d* includes straight tapered wall segment T4 that defines an angle of about 25° and the arcuate surface R4 has a radius of about 0.298 inch while the outside radius OR4 is very small and about 0.058 inch. A reduced diameter cylindrical surface 244 extends above the arcuate surface R4. Thus, the cylindrical neck 236 is further reduced in diameter by about 0.050 inch, while the tapered-in portion is axially enlarged and the angle of the straight tapered neck portion between the two arcuate segments is reformed while the metal in the reduced cylindrical neck and the necked-in portion are further compressed. The arcuate shoulder or bump becomes set in the fourth operation in view of the small radius OR4 engaging the upper end thereof.

The resultant tapered-in portion 246 includes an upper arcuate segment CR4, a tapered portion CT4 and a lower arcuate segment CA4 having an upper arcuate portion COR4, along with reduced cylindrical neck portion 248. The fourth operation is illustrated in FIG. 16(*c*) and it should again be noted that the tapered portion CT4 does not conform to the configuration of the die surface T4 and is a compound curve in the axial direction.

The fifth necking die 130E (FIG. 10), has a reduced diameter surface 250 above a transition zone 252 which includes an arcuate surface R5 that has a radius of about 0.230 inch. The transition zone also includes a tapered surface T5 which defines an angle of 20° with a surface OR5 having an external radius of about 0.180 inch above cylindrical surface 202*e*. The fifth operation is illustrated in FIG. 16(*d*) where the container has a tapered portion 256 including a lower segment CA5, COR5, a tapered segment CT5 and an upper arcuate segment CR5 with a reduced diameter neck 254.

Figure 11:
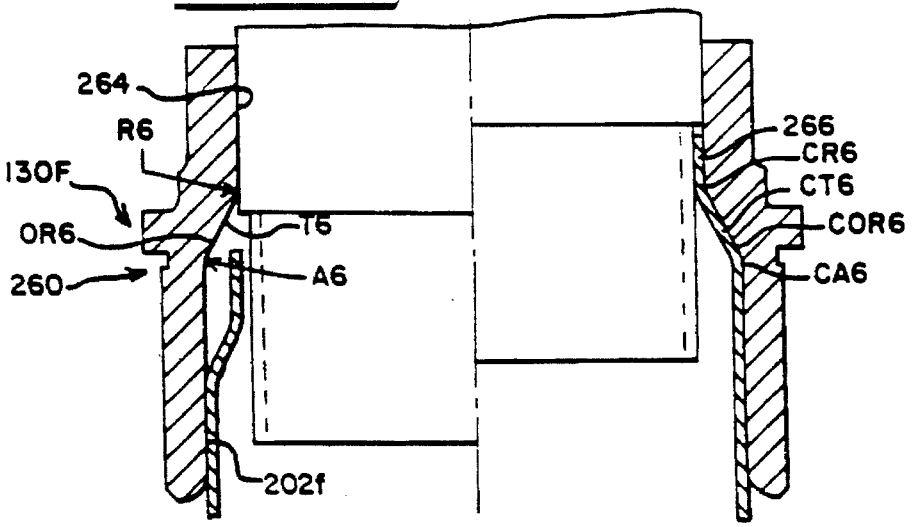

In the final and sixth necking die 130F is shown in FIG. 11, where the transition zone 260 above a lower cylindrical surface portion 202*f*, includes a first lower arcuate surface segment OR6 having an external radius of about 0.180 inch which merges with a flat tapered portion T6 that defines an angle of about 20° and a second arcuate surface segment R6 that has an external radius of about 0.220 inch which merges with a reduced diameter surface 264.

In the sixth necking operation, the reduced diameter portion 264 of the die reduces the cylindrical neck by about 0.050 inch while the necked-in portion is reformed to its final configuration, illustrated in FIG. 14, to be described later. The final reduction is illustrated in FIG. 16(*e*) wherein the tapered portion 265 has a first arcuate segment CA6, COR6, a tapered portion CT6 and a second arcuate segment CR6 below a reduced cylindrical neck 266. It will be noted that the entire tapered segment CT6 is reformed inwardly from the position shown in dotted line to that shown in solid line.

Thus, the necking operation forms a smooth tapered necked-in portion between the container side wall and the reduced diameter cylindrical neck. This necked-in portion or taper includes a first arcuate segment integral with the side wall and a second arcuate segment integral with the reduced cylindrical neck. During the necking operation, the neck, comprising the reduced diameter cylindrical neck and the necked-in portion, is formed in segments while the axial dimension is increased and the cylindrical neck is further reduced in diameter and in axial length while a rounded shoulder is formed at the end of the side wall. At the same time, a straight tapered wall section or segment is created in the necked-in or tapered portion.

In each of the six necking operations, the principal forces applied to the neck of the container, which includes the tapered or necked-in portion are radially inwardly-directed forces and therefore the metal is primarily compressed and localized bending is minimized. The tapered portion is allowed to determine its profile because it is not constrained by the die below the contact area and is thus not dependent on the configuration of the lower portion of the transition zone of the die. Of course, the forming sleeve or element 150 will direct the upper edge of the container 16 into the annular slot defined between the forming sleeve or element and the reduced cylindrical portion of the die 130. Stated another way, the forming element 150 which engages the inner surface of the container 16 provides a guiding function or form control function.

As indicated above, the necked-in portion between the reduced diameter cylindrical neck portion and the cylindrical side wall is freely formed and its configuration does not conform to the transition zone of the die. The following tables illustrate the die dimensions and the amount of forming that takes place in each of the necking operations. In a preferred embodiment of the invention, where a 211 aluminum container is reduced to a 206 neck in six operations, the following die dimensions were used:

TABLE I

| | Die Dimensions | | | |
|---|---|---|---|---|
| Operation | A | OR | R | T |
| I | .220 | | .120 | |
| II | .280 | | .180 | |
| III | .030 | .180 | .260 | 27 |
| IV | .058 | .058 | .298 | 25 |
| V | — | .180 | .230 | 20 |
| VI | — | .180 | .220 | 20 |

These dimensions are the actual dimensions in inches and degrees utilized in the transition zone of the die where A is the internal radius of the first lower arcuate segment surface, R is the radius of the second upper arcuate segment surface and T is the angle of the tapered surface therebetween, while OR is the external radius of the upper portion of the first arcuate segment surface. These dies produced a neck having the following dimensions in inches and degrees:

TABLE II

| | Can Dimensions | | | |
|---|---|---|---|---|
| Operation | CA | CR | COR | CT |
| I | .29 | .33 | | |
| II | .24 | .22 | | |
| III | .21 | .38 | | |
| IV | .20 | .49 | .64 | |
| V | .23 | .31 | .28 | 21 |
| VI | .12 | .37 | .25 | 21 |

where CA is the radius of the first lower arcuate segment, CR is the radius of the second upper arcuate segment, COR is the external radius of the upper portion of the first arcuate segment and CT is the angle of taper between the arcuate segments.

It can be seen that the second or upper arcuate segment CR, which is the upper part of the necked-in portion, is reformed in each subsequent necking operation while the tapered portion is enlarged. At the same time, the first arcuate segment CA, while not being positively reformed by the die, will have a change in its radius of curvature due to a free forming resulting from the inherent spring back characteristics of the metal. It should be noted that the dies in the third and fourth operations have flat tapered surfaces T but that the tapered wall segment CT is not formed in the container until the fifth and sixth necking operations. This is believed to result from the free forming of the necked-in portion rather than conforming the necked-in portion to the die. The necking operation causes a thickening of the metal which is greatest adjacent the upper open end where a flange is formed. This strengthens the flange and minimizes flange cracks.

The finished 206-neck on the upper end of a 211-cylindrical side wall of the container is shown in enlarged view in FIG. 14 wherein a first arcuate segment 280 is formed on the end of the cylindrical side wall 282, a straight smooth flat inwardly-tapered segment 284 is formed on the end of the arcuate segment 280 and a second arcuate segment 286 merges with the reduced cylindrical neck portion 288 of the container. In the final configuration, shown in FIG. 14, the first or lower arcuate segment 280 is essentially a compound curve that has a first arcuate segment having an internal radius R7 and a second arcuate segment having an external radius RS. The final radius R7 in the embodiment described is preferably on the order of about 0.119 inch, while the external radius R8 is on the order of about 0.253 inch. The tapered flat segment 284 defines an angle of about 20°±1 with respect to the center axis of the container or a plane extending parallel to the side wall 282 while the external radius R9 of the second arcuate segment is about 0.371 inch.

As shown in FIGS. 12, 14 and 16–21 the resultant container has a single shoulder or rib between the cylindrical side wall 282 and the reduced diameter neck portion 288 at the open end. A single inwardly tapered annular straight segment or wall 284 extends from the single shoulder to the reduced diameter neck portion 288. The inwardly tapered straight segment 284 comprises first, second, third, fourth, fifth and sixth tapered portions, CT1–CT6 in FIG. 19, which are respectively disposed between the shoulder and the reduced diameter neck portion 288.

An outwardly-directed flange 290 is then formed on the reduced neck by the flanging module 36, which may be of the type disclosed in U.S. Pat. No. 3,983,729.

The container produced by the die necking method described above has improved crush resistance and strength because the metal in the neck of the container is thicker due to the radial compression of the metal therein.

The container neck made in accordance with the invention also has better symmetrical geometry when compared to spin necked containers produced by presently-known commercial spin necking operations because the container is devoid of the ridges produced in the neck during the spin forming process. The die-necked container also has less symmetrical distortion and flanges of more consistent width. The die-necked smooth-tapered wall and its inclination gives the container greater crush resistance and column strength when compared with spin necked containers.

The die-necking method of the invention also eliminates deterioration of the coating or label which is usually applied before the necking operation is performed. The necked-in container also is devoid of any scratches as compared to a spin-necked container. The smooth-tapered necked in portion can also be used as part of the label.

A slightly modified neck profile is illustrated in FIGS. 19–21 wherein the necked-in portion of the neck is of a different configuration than that shown in FIGS. 16–18 to produce a shorter neck on a 211-container which thereby increases the fill capacity. In this embodiment, a 211-container is necked down to a 206-diameter in six necking operations producing substantially equal reductions using necking dies and form control members similar to those described above but having different configurations.

The following table shows the die dimensions of the six dies used in forming a 206 neck, shown in FIG. 21, on a 211-aluminum container wherein FSR is the radius of the lower arcuate surface segment of the die, SSR is the radius of the upper arcuate surface segment, NSD is the diameter of the reduced diameter neck surface and T is a reference angle of the tapered surface between the two segments, while S is the spacing between the centers of the two radii.

TABLE III

| | Die Dimensions | | | | |
|---|---|---|---|---|---|
| OP | FSR | SSR | S | T | NSD |
| I | 0.280 | 0.200 | 0.173 | | 2.529 |
| II | 0.280 | 0.260 | 0.244 | | 2.479 |
| III | 0.250 | 0.250 | 0.291 | 28 | 2.427 |
| IV | 0.250 | 0.240 | 0.345 | 28 | 2.375 |
| V | 0.250 | 0.260 | 0.396 | 28 | 2.323 |
| VI | 0.250 | 0.260 | 0.429 | 28 | 2.273 |

FIGS. 19(*a*) through 19(*e*) shows the radial compression of the neck in each of the necking operations wherein the first or lower arcuate segment is identified by the reference CFSR, the upper or second arcuate segment is identified by the reference CSSR, all expressed in inches, while the taper angle between the arcuate segments is identified by reference CT in degrees.

Thus, the configuration of the neck after the first necking operation is illustrated in dotted line in FIG. 19(*a*), while the solid line therein shows the neck configuration after the second necking operation. FIGS. 19(*b*), 19(*c*), 29(*d*) and 19(*e*) show the same sequence for the next four sequential necking operations while the following table shows the respective container dimensions in inches:

TABLE IV

| | Can Dimensions | | | |
|---|---|---|---|---|
| OPERATION | CFSR | CSSR | CS | CT |
| I | 0.28 | 0.25 | 0.19 | 20° |
| II | 0.32 | 0.35 | 0.28 | 23° |
| III | 0.23 | 0.23 | 0.29 | 24° |
| IV | 0.25 | 0.31 | 0.36 | 26.5° |
| V | 0.25 | 0.35 | 0.38 | 26° |
| VI | 0.23 | 0.30 | 0.43 | 26° |

The finished necked and flanged container is illustrated in FIG. 21 and includes a cylindrical side wall 300 having a first or lower arcuate portion 302 which has a radius CFSR of about 0.23 inch that merges with an inwardly-smooth tapered portion 304 which defines an angle of about 26°±2°. The upper or second arcuate segment 306 has a radius CSSR of about 0.30 inch which merges with the reduced cylindrical neck 307 that has the flange 308 formed on the upper free end thereof. The spacing CS, between the centers of the radii of the two arcuate segments is about 0.43 inches.

As in the previous embodiment, the lower arcuate segment is minimally freely reformed in the six necking operations while the upper part of the necked-in portion, including the second arcuate segment, is repeatedly reformed and integrates with a previously-formed portion to produce the smooth inwardly-tapered flat segment between the arcuate segments of the necked-in portion.

The neck of the container again is devoid of any marks or scratches and the tapered portion is suitable for use as part of the label that is usually applied to the container prior to the necking operation.

In the embodiment illustrated in FIGS. 19–21, the necking is done in equal increments in the six necking operations and the initial forming of the portion of the container that has the neck formed therein has been omitted. However, in certain instances, the initial forming operation described in connection with FIG. 6 can be utilized. This, to some measure, will be dependent upon the condition of the containers received by the necking system. Of course, the specific configuration of the tapered portion of the neck can be changed to any desired profile by proper selection of die dimensions and operations.

The system has great flexibility in that a "211" container can be necked to a "209" diameter, a "207.5" diameter or a "206" diameter merely by eliminating stations. For example, a "209" diameter neck can be produced on a "211" diameter container utilizing only the first and second necking operations, illustrated in FIGS. 6 and 7. A "207.5" necked container can be produce with the four necking dies illustrated in FIGS. 6–9 and a "206" necked container can be produced with the six dies illustrated in FIGS. 6–11. This can be performed in the die necking system disclosed by replacing the appropriate necking segments with dwell cam segments, as explained U.S. Pat. No. 4,519,232. Alternatively, selected necking station modules could be by-passed, if desired.

The use of two additional modules can produce a "204" diameter neck utilizing two additional necking dies. Further reductions to a "202" or a "200" diameter or less can be produced utilizing additional necking dies. Also, the system can be used to produce triple or quad neck-in portions as disclosed in U.S. Pat. No. 4,519,232.

As mentioned above, the number of necking dies can be varied and the amount of reduction in each operation can be changed without departing from the spirit of the invention. For example, it is possible to reduce a "211" can down to a "206" diameter neck utilizing, for example, five die necking operations. The containers that are necked could also be initially smaller in diameter, such as, for example, a "209" or smaller diameter. When necking a "209" or smaller diameter container, the dies in the necking modules are changed to accommodate the different size of container, and to produce the desired reductions in each of the necking modules.

Although the invention has been described in terms of a preferred embodiment, it will be apparent that various modifications may be made without departing from the true spirit and scope thereof, as set forth in the following claims.

I claim:

1. A cylindrical can body for a two-piece metal container comprising a cylindrical side wall extending from an integral bottom end wall, a single smooth necked in portion at an end of said cylindrical side wall having a single inwardly tapered annular straight segment extending from a single shoulder between said side wall and a reduced diameter neck portion at an open end of said can body, said inwardly tapered annular straight segment comprising a first radially compressed tapered portion having a single compressed lower segment, and a second further radially compressed tapered portion extending from an upper part of said first tapered portion, said second tapered portion disposed between said first tapered portion and said reduced diameter neck.

2. The can body of claim 1 wherein said inwardly annular straight segment further comprises a third further compressed tapered portion extending from said second tapered portion, said third tapered portion disposed between said second tapered portion and said reduced diameter neck.

3. The can body of claim 2 wherein said inwardly annular straight segment further comprises a fourth further compressed tapered portion extending from said third tapered portion, said fourth tapered portion disposed between said third tapered portion and said reduced diameter neck.

4. The can body of claim 3 wherein said inwardly annular straight segment further comprises a fifth further compressed tapered portion extending from said fourth tapered portion, said fifth tapered portion disposed between said fourth tapered portion and said reduced diameter neck.

5. The can body of claim 4 wherein said inwardly annular straight segment further comprises a sixth further compressed tapered portion extending from said fifth tapered portion, said sixth tapered portion disposed between said fifth tapered portion and said reduced diameter neck.

6. The can body of claim 1 further comprising an outwardly directed flange extending from said reduced diameter neck portion.

7. The can body of claim 1 further comprising an end panel double seamed to said open end of said can body.

8. The can body of claim 1 wherein said reduced diameter portion has a diameter of approximately 2.125 inches.

9. The can body of claim 1 wherein said reduced diameter portion has a diameter of approximately 2.0 inches.

10. The can body of claim 1 wherein said reduced diameter portion has a diameter of approximately 2.25 inches.

* * * * *